US010500884B2

(12) United States Patent
Roth

(10) Patent No.: US 10,500,884 B2
(45) **Date of Patent: *Dec. 10, 2019**

(54) THERMAL SENSITIVE MEDIA WITH INTERNAL RF PRINTING MATRIX

(71) Applicant: AVERY DENNISON RETAIL INFORMATION SERVICES, LLC, Westborough, MA (US)

(72) Inventor: Mark W. Roth, North Miami, FL (US)

(73) Assignee: AVERY DENNISON RETAIL INFORMATION SERVICES LLC, Mentor, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/625,196

(22) Filed: Jun. 16, 2017

(65) Prior Publication Data

US 2017/0282627 A1 Oct. 5, 2017

Related U.S. Application Data

(62) Division of application No. 14/576,560, filed on Dec. 19, 2014, now Pat. No. 9,821,587.

(51) Int. Cl.
*B41M 5/40* (2006.01)
*B41M 5/337* (2006.01)
(Continued)

(52) U.S. Cl.
CPC ..... *B41M 5/405* (2013.01); *B41M 5/337* (2013.01); *B41M 5/41* (2013.01); *B41M 5/42* (2013.01);
(Continued)

(58) Field of Classification Search
CPC ..... B41M 5/20; B41M 7/00; B41M 7/0054; B41M 7/0081; B41M 2205/36; B41M 2205/40
(Continued)

(56) References Cited

U.S. PATENT DOCUMENTS 4,886,774 A * 12/1989 Doi ..... B41M 5/405 503/226
5,371,058 A * 12/1994 Wittig, Jr. ..... B41M 5/405 428/203
(Continued)

FOREIGN PATENT DOCUMENTS

| | | |
|---|---|---|
| WO | 1993/025393 | 12/1993 |
| WO | 2009/054991 | 12/1993 |
| WO | 2006/098507 | 4/2009 |

OTHER PUBLICATIONS

International Search Report and Written Opinion prepared for PCT/US2015/066232 dated Mar. 14, 2016.

*Primary Examiner* — Gerard Higgins
(74) *Attorney, Agent, or Firm* — Avery Dennison Retail Information Services LLC

(57) ABSTRACT

A thermal sensitive media for use with labeling or identification methods is disclosed. The thermal sensitive media comprises a media layer and a thermally sensitive record layer formed upon at least one surface of the media layer. The thermally sensitive record layer forms a visually discernable colored image in response to heat. However, the colored image is subject to degradation as a result of exposure to ultraviolet radiation within a known photodegradative wavelength range. An ultraviolet protective coating layer may then disposed over the thermally sensitive record layer. A lamination layer is positioned internal to the media layer and comprises a matrix of micro heating elements driven by radio frequency (RF) power. The matrix of micro heating elements are arranged in a pin array to energize the micro heating elements within the laminated media structure to create a simple numeric image.

20 Claims, 2 Drawing Sheets

(51) Int. Cl.

| | |
|---|---|
| ***B41M 5/41*** | (2006.01) |
| ***B41M 5/44*** | (2006.01) |
| ***B41M 5/42*** | (2006.01) |
| ***B41M 5/46*** | (2006.01) |
| *B41M 7/00* | (2006.01) |

(52) U.S. Cl.
CPC ..... *B41M 5/44* (2013.01); *B41M 5/46* (2013.01); *B41M 7/0054* (2013.01); *B41M 7/0081* (2013.01); *B41M 2205/04* (2013.01); *B41M 2205/36* (2013.01); *B41M 2205/40* (2013.01)

(58) Field of Classification Search
USPC ..... 503/200, 226
See application file for complete search history.

(56) References Cited

U.S. PATENT DOCUMENTS

| | | | | |
|---|---|---|---|---|
| 7,262,150 | B2 * | 8/2007 | Kalishek | B41M 5/30 503/200 |
| 8,207,824 | B2 | 6/2012 | Keeton et al. | |
| 8,530,377 | B2 | 9/2013 | Tsuchimura et al. | |
| 8,569,208 | B1 | 10/2013 | Ribi et al. | |
| 9,821,587 | B2 * | 11/2017 | Roth | B41M 5/337 |
| 2005/0282704 | A1 | 12/2005 | Kalishek et al. | |

* cited by examiner

THERMAL SENSITIVE MEDIA WITH INTERNAL RF PRINTING MATRIX

CROSS REFERENCE TO RELATED APPLICATION(S)

The present application claims priority to and the benefit of U.S. patent application Ser. No. 14/576,560 filed on Dec. 19, 2014, which is incorporated herein by reference in its entirety.

BACKGROUND

The present invention relates generally to thermal sensitive media with internal RF printing matrix. More particularly, the present disclosure relates to a thermal sensitive media that may be UV coated with an internal radio frequency (RF) matrix to provide a means to impart human readable information on media containing a RFID inlay when a RFID encoding process is used without the benefit of a print mechanism at the time the RFID device is encoded.

Currently, one of the largest drawbacks of using pressure sensitive thermal media in the creation of tags and labels is that this type of media cannot handle any lengthy exposure to UV energy (light) for any duration of time without turning black or otherwise discoloring. The surface coating of thermal media is intentionally designed to be directly influenced by some sort of heating (energy) element so an image can be created on its surface. Thus, its current strength is also its weakness preventing wider acceptance of uses in labeling or identification methods.

Other methods for use in printing labels can be achieved though thermal transfer ribbons. However, this requires a ribbon supply of material in order to complete the imaging of the label.

Furthermore, when performing RFID encoding of an inlay, containing an integrated circuit or chip, laminated within a structure, such as a pressure sensitive label, normally the media itself has to be passed through a RFID printer (i.e., thermal, inkjet, impact, etc.) to impart a human readable image on the surface of the media in which the RFID inlay is contained to allow anyone to understand what the inlay was encoded with or the product with which the inlay is associated. Thus, a thermal printer, equipped with RFID technology, is responsible for the interrogation and encoding of the RFID inlay contained within the laminated media and the printing apparatus of the printer itself has the responsibility to create an image, human readable or machine readable such as a bar code, on the surface of the media.

However, using a printer of any kind is not a practical method to impart an image on each individual item when items are bulk packed into cartons, such as when items are manufactured and then shipped to a distribution point or retailer, where the individual items are removed and then displayed or further transported to the next destination. To remove each item from the carton and route each tag through a printer by some means into a RFID capable printer is simply not feasible. Currently, there is no means to place an image on the surface of the tags or labels other than printing during the encoding process. This is not very practical if the intention is using RFID to conduct bulk encoding wherein all of the inlay as well as the media are essentially blank until encoded. The user would have to open the carton and retrieve each item that was tagged. It defeats the advantage provided in speed and handling of cartons by not touching each item in the carton in the first place.

The present invention discloses a thermal sensitive media with an internal radio frequency (RF) matrix to provide a means to impart human or machine readable information on media containing an RFID inlay when a RFID encoding process is used without the benefit of a print mechanism in which the media may be UV coated. Specifically, the media has a lamination layer internal to the media itself that contains a matrix of micro heating elements which can be activated by RF power. Use of this internal matrix printing allows for utilization of a UV protective coating on the outer most layer of the media surface to protect the subcutaneous thermal layer from changing color other than intended by the internal matrix.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, includes thermal sensitive media for use with labeling or identification methods in which the thermal sensitive media may be UV coated. The thermal sensitive media has a media layer and a thermally sensitive record layer formed upon at least one portion of the surface of the media layer. The thermally sensitive record layer forms a visually discernable colored image in response to heat or other energy. However, the colored image is subject to degradation as a result of exposure to ultraviolet radiation within a known photodegradative wavelength range. In one embodiment of the present invention, an ultraviolet protective coating layer is disposed over the thermally sensitive record layer. The ultraviolet protective coating layer is such that the coating can be cured or activated with ultraviolet radiation at a wavelength outside of the known photodegradative wavelength range.

In a preferred embodiment, a lamination layer is positioned internal to the media layer and includes a matrix of micro heating elements driven by radio frequency (RF) power. The matrix of micro heating elements are arranged in a pin array to energize the micro heating elements within the laminated media structure to create a simple numeric image. Laser cutting processes are used to create the matrix and fine circuit traces are used to link the matrix back to a discharge generator. Thus, the use of inductive coupling and capacitance would sequentially create an image on the surface of the media. In another embodiment, an open segment LED array may be utilized as opposed to a pin array.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION

Figure 1:
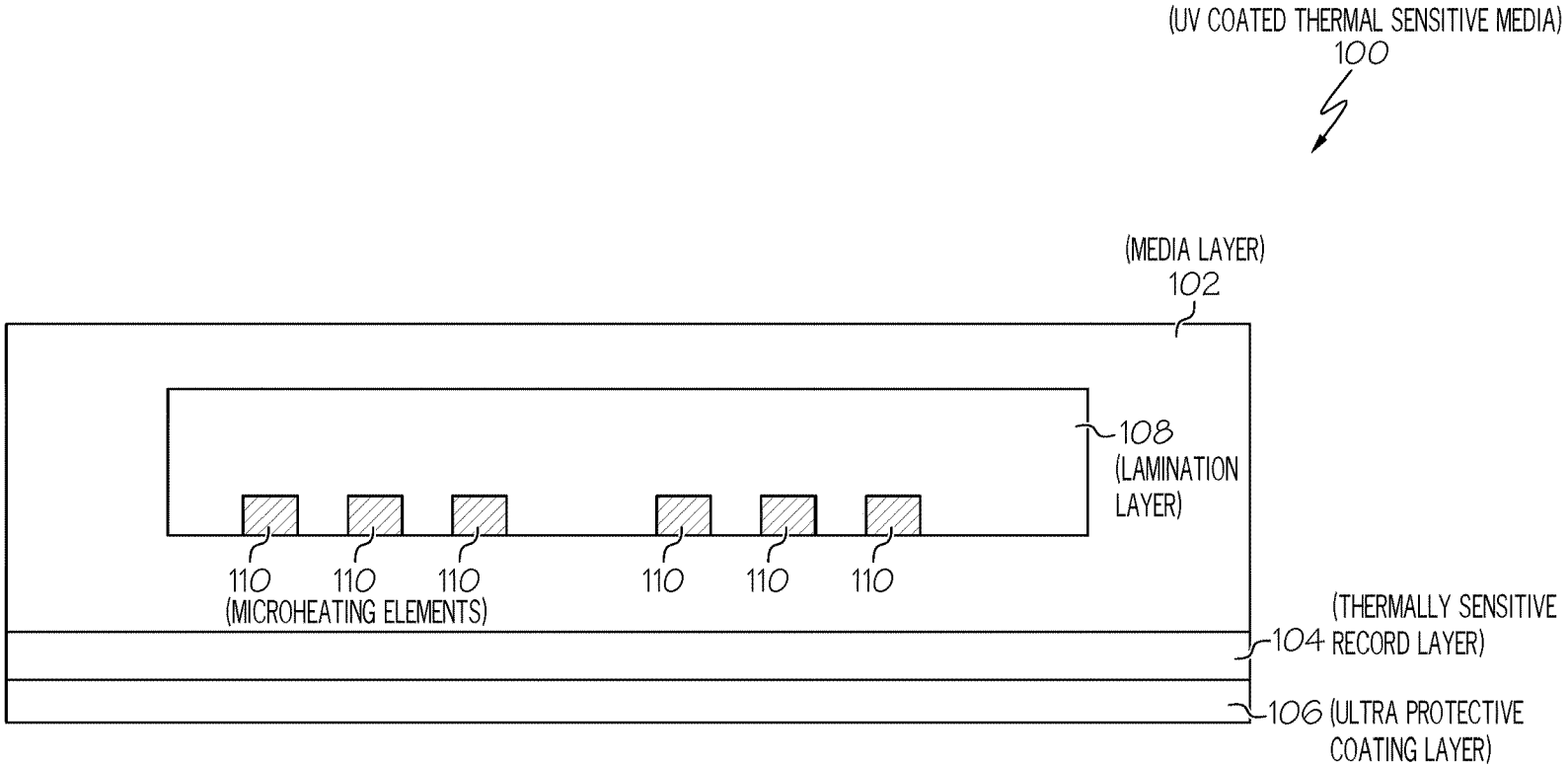
FIG. 1 illustrates a perspective view of the UV coated thermal sensitive media in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Generally, radio frequency identification (RFID) tags are electronic devices that may be affixed to items whose presence is to be detected and/or monitored. The RFID inlay is a RFID tag in a smart label. RFID inlays typically include a chip and an antenna that may be aluminum, copper or silver connected to the chip. The antenna/chip combination is bonded to a substrate layer, which can be any suitable material such as paper, polyester, PET or the like, that is delivered to the label maker "dry" (without adhesive) or "wet" (attached to a pressure sensitive liner). The present invention contemplates that the substrate layer may be constructed using a wide variety of materials. Suitable RFID inlays used in connection with the present invention are available from Avery Dennison RFID Company, Greensboro, N.C.

The RFID inlay is adhered to the back side of the label or inserted within a label and then printed and encoded in an RFID printer. The presence of an RFID inlay, and therefore the presence of the item to which the RFID inlay is affixed, may be checked and monitored by devices known as "readers" or "reader panels." Readers typically transmit radio frequency signals to which the RFID inlays respond. Each RFID inlay can store a unique identification number. The RFID inlays respond to reader-transmitted signals by providing their identification number and additional information stored on the RFID inlay based on a reader command to enable the reader to determine an identification and characteristics of an item.

The present invention discloses a thermal sensitive media with an internal radio frequency (RF) printing matrix to provide a means to impart human readable information on media containing a RFID inlay when a RFID encoding process is used without the use of a RFID printer. The present invention contemplates that the media is UV coated thermal sensitive media however it is acknowledged that the media is not limited to such. The media has a lamination layer internal to the media itself that contains a matrix of micro heating elements driven or activatable by RF power.

Figure 2:
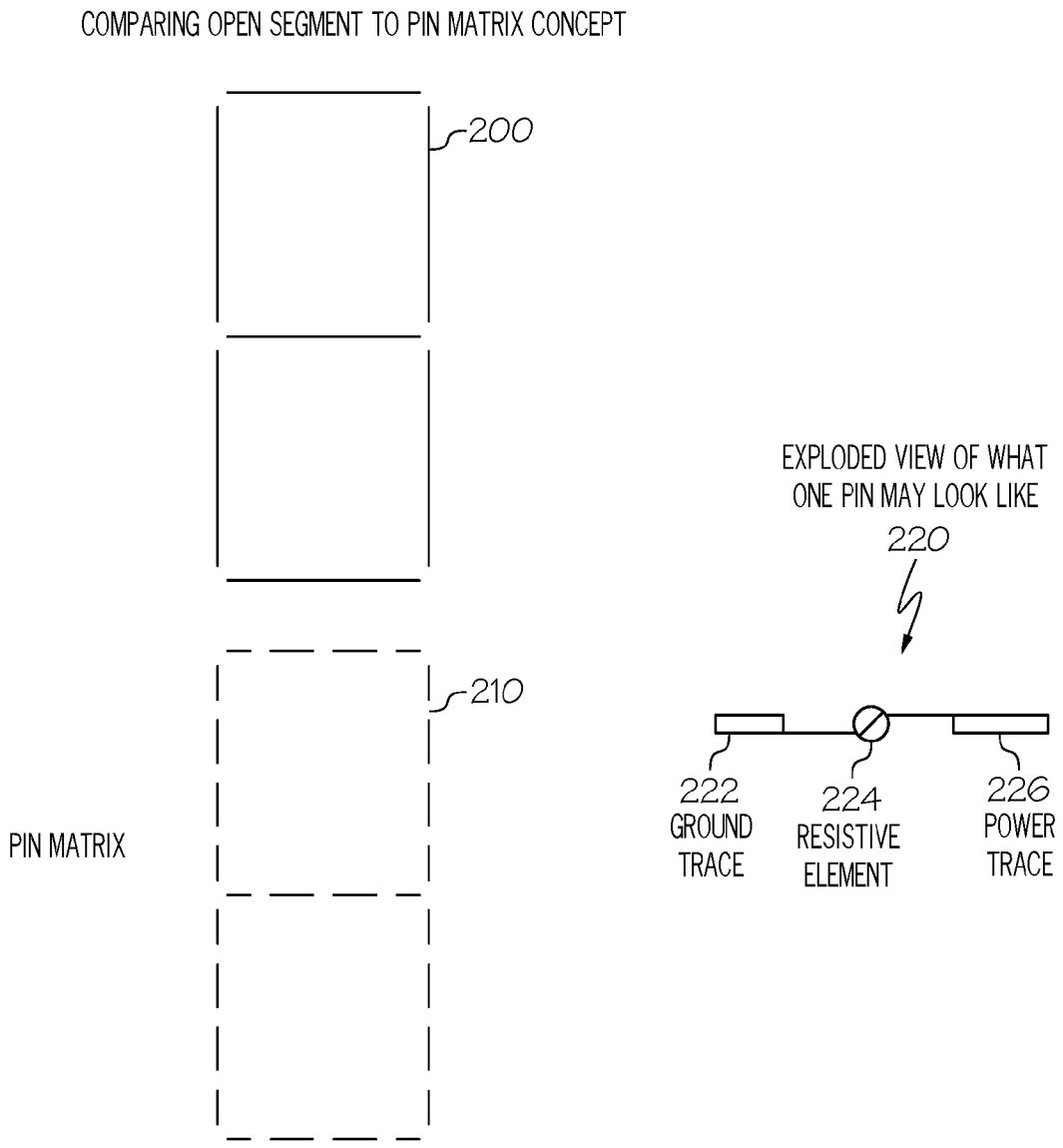
FIG. 2 provides a comparison between an open segment print and pin matrix on the thermal sensitive media of the present invention.

In one embodiment contemplated by the present invention, use of this internal matrix printing allows for utilization of a UV protective coating on the outer most layer of the media surface to protect the subcutaneous thermal layer from changing color other than as intended by the internal matrix and subsequent printing to be performed. The matrix of micro heating elements are arranged in a pin array to energize the micro heating elements within the UV coated thermal sensitive media structure to create for example a simple numeric image as seen in FIG. 2.

Referring initially to the drawings, FIG. 1 illustrates an ultraviolet (UV) coated thermal sensitive media 100 for use with labeling or identification methods, or any other suitable methods as is known in the art. The UV coated thermal sensitive media 100 includes an internal radio frequency (RF) printing matrix to provide a means to impart human readable information on media containing an RFID inlay when an RFID encoding process is used without the use of a print mechanism.

The thermal sensitive media 100 comprises a media (or base) layer 102 and a thermally sensitive record layer 104 formed upon at least a portion of one surface of the media layer 102. The media layer 102 is typically paper or plastic and one which is suitable for use with a pressure sensitive material, or any other suitable material as is known in the art, depending on the use of the UV coated thermal sensitive material 100.

The thermally sensitive record layer 104 formed to a surface of the media layer 102, forms a visually discernable colored image in response to heat. However, the colored image is subject to degradation as a result of exposure to ultraviolet radiation within a known photodegradative wavelength range.

Additionally, when the thermally sensitive record layer 104 is incorporated or used with a tape or an adhesive, it is preferably formed of a suitable material that can be used with the tape or adhesive, such as a silicone, urethane or an acrylic adhesive resin and titanium diboride, alone or in combination with one or more additional thermally conductive fillers. Such resins are well known and commercially available.

When the thermally sensitive record layer 104 is in the form of a coating, film, paint, decal, or applique, it is preferably formed of a synthetic polymer, such as, but not limited to: polyethylene, polypropylene, cellulose acetate, polyester, polystyrene, polyamide, polycarbonate, polyolefin, fluoropolymer, polyvinyl chloride, and polyimide polymers. However, the thermally sensitive record layer 104 does not need to be limited to a particular homopolymer but may also be comprised of a polymer blend having separate or different Tg, Td, or Tm.

An ultraviolet protective coating layer 106 is then disposed over the thermally sensitive record layer 104 in one embodiment as illustrated in FIG. 1. The ultraviolet protective coating layer 106 comprises cured ultraviolet radiation at a wavelength outside of the known photodegradative wavelength range. Furthermore, the cured ultraviolet protective coating layer 106 comprises at least one additive capable of preventing transmission therethrough of ultraviolet radiation within the known photodegradative wavelength range. Typically, the known photodegradative wavelength range is 340-390 nm and the ultraviolet protective coating layer 106 has been cured by exposure to ultraviolet radiation at a wavelength below 330 nm.

UV absorbers capable of absorbing radiation within the 340-390 nm range generally include those compounds of the hydroxyphenyl benzotriazole class. Known UV absorbers within such class include, but are not limited to: 2(2'-Hydroxy-5'-methaylphenyl)benzotriazole; 2-3(3'5'-Di-t-butyl-2'-hydroxyphenyl)-5-chlorobenzotriazole; 2-(3'-1-Butly-2'-hydroxy-5'-methanlyphenyl)-5-chlorobenzotriazole; 2(2'-Hydroxy-3',6'-di-t-butylphenyl)benzotriazole; 2(2'-Hydroxy-3',5'-di-t-amylphenyl)benzotriazole; 2(2'-Hydroxy-5-t-octylphenyl)benzotriazole; Poly(oxy-1,2-ethanediyl), α-(3-(3-(2H-benzotriazol-2-yl)-5-(1,1-dimethylethyl)-4-hydroxyphenyl)-1-oxopropyl)-ω-hydroxy; Poly(oxy-1,2-ethanediyl), α-(3-(3-(2H-benzotriazole-2-yl)-5-(1,1-dimethylethyl)-4-hydroxyphenyl)-1-oxopropyl-ω-(3-(3-2H-benzotriazol-2-yl)-5-(1,1-dimethylethyl)-4-hydroxyphenyl)-1-oxopropoxy.

Additionally, the ultraviolet protective coating layer 106 comprises at least one light stabilizer capable of scavenging free radicals upon exposure to ultraviolet radiation within the known photodegradative wavelength range, or any other suitable additive capable of preventing transmission therethrough of ultraviolet radiation within the known photodegradative wavelength range. These light stabilizers are known to exhibit light stabilizing synergy with certain UV absorbers. Beyond such light stabilizing synergy, however, such compounds are known to exhibit specific antioxidative and free radical trapping or scavenging effects. These properties of the "light stabilizers" are unique and particularly advantageous when applied to heat sensitive record materials because certain colored images formed on the thermally sensitive materials are known to undergo quenching or degradation when acted upon by certain free radicals. The ability of these "light stabilizers" to trap or scavenge free radicals thus serves to prevent certain degratory effects of free radicals within the protective coating layer 106 and/or the underlying thermally sensitive record layer 104 where they could fade or degrade the colored image.

One group of compounds known to be effective as free radical scavenging light stabilizers are the sterically hindered amines. Most of the commercially available light stabilizers of the hindred anime class are derivatives of 2,2,5,5-tetramethyl piperdine, such as but not limited to Bis(1,2,2,6,6-pentamethyl-4-piperidinyl sebacate.

Furthermore, the ultraviolet protective coating layer 106 may be applied to one or more surfaces of the thermally sensitive record layer 104 at thicknesses sufficient to ensure the desired protection from physical abrasion, chemical damage and ultraviolet radiation while, at the same time, allowing sufficient heat transmission and flexibility as not to deter or prevent the routine use and formation of thermally printed images on the underlying thermally sensitive record layer 104.

Additionally, the ultraviolet protective coating layer 106 may be applied in combination with other types of protective films so as to form various laminate or multi-layered composite structures. For example, a layer of polyester film may be incorporated between the ultraviolet protective coating layer 106 and the thermally sensitive record layer 104 for the purpose of providing further chemical resistance or preventing liquid permeation.

Next, a lamination layer 108 is positioned internal to the media layer 102 and comprises a matrix of micro heating elements 110 driven by radio frequency (RF) power. The matrix of micro heating elements 110 are arranged in a pin array to energize the micro heating elements 110 within the laminated media structure 100 to create a simple numeric image. Much like the segments seen in a typical basic LED array, the pin array would only fire those pins (or micro heating elements 110) required to formulate an image.

Laser cutting processes are used to generate thin foil antenna profiles are well established in the art. Thus, the use of such laser cutting techniques, or any other suitable techniques, can be used to achieve the extremely high resolution needed to create a very fine matrix of pins or micro heating elements 110 (resistance). The grid of these elements 110 can then be linked via fine circuit traces back to a discharge generator or other suitable component.

Thus, the use of inductive coupling and capacitance would individually heat the micro heating elements 110 to create an image on the surface of the media 100. Instead of pins impacting the paper in a sequence of events to create a numeric string, the "pins" fire much like a bit map would look like.

Further, only enough pin (pixel) resolution is generated to create the very most basic of alpha-numeric images to let the user looking at each individual media tag know visually what has been encoded in the inlay. The inlay composite media would then need to remain in an RF field for a specific amount of time to re-energize after each pin fire sequence. Specifically, the media 100 generates only the minimum requirements needed to provide just enough energy to fire a single pin then recharge quickly for the next pin (micro heating elements 110). Further, it is anticipated that coil design and capacitance will determine the volume of elements that can be energized at any one time.

In one embodiment, the matrix presently set forth is controlled via a communications link provided in a RFID chip. A matrix as set forth in the present invention may be controlled by the utilization of at least two chips contained within the same inlay that controls the matrix. The matrix presently described may also be controlled by additional processing power that is integrated into a single RFID chip to handle this matrix printing task.

Attention is now directed to FIG. 2 which shows an open segment print 200 and a pin matrix print 210. An exploded view of the pin matrix print 210 is shown by reference numeral 220 which provides for a ground trace 222, resistive element 224 and power trace 226. What has been described above includes examples of the claimed subject matter.

It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A thermal sensitive media, comprising:

a media layer;

a lamination layer disposed internal to the media layer, the lamination layer comprising a matrix of micro heating elements linked via fine circuit traces to a discharge generator;

a thermally sensitive record layer formed upon at least a portion of one surface of the media layer;

wherein the thermally sensitive record layer forms a visually discernable colored image in response to heat; and an ultraviolet protective coating layer, where the protective coating layer comprises at least one light stabilizer and the at least one light stabilizer is a sterically hindered amine and the at least one stabilizer is capable of scavenging free radicals upon exposure to ultraviolet radiation; wherein the colored image is subject to degradation as a result of exposure to ultraviolet radiation within a known photodegradative wavelength range.

2. The media of claim 1, wherein the ultraviolet protective coating layer is disposed over the thermally sensitive record layer.

3. The media of claim 2, wherein the ultraviolet protective coating layer contains at least one additive capable of preventing transmission therethrough of ultraviolet radiation within the known photodegradative wavelength range.

4. The media of claim 3, wherein the known photodegradative wavelength range is 340-390 nm and wherein the protective coating layer has been cured by exposure to ultraviolet radiation at a wavelength below 330 nm.

5. The media of claim 3, wherein the additive is a UV absorber.

6. The media of claim 5, wherein the UV absorber is a hydroxyphenyl benzotriazole.

7. The media of claim 2, wherein the protective coating layer is applied at a thickness sufficient for protection.

8. The media of claim 1, wherein the micro heating elements are activated by radio frequency (RF) power.

9. The media of claim 8, wherein the matrix of micro heating elements are arranged in a pin array.

10. The media of claim 9, wherein a laser cutting process is used to create the matrix of micro heating elements.

11. The media of claim 1, wherein inductive or capacitance coupling energy activates the micro heating elements to create an image on the surface of the media.

12. The media of claim 1, wherein the at least one light stabilizer capable of scavenging free radicals upon exposure to ultraviolet radiation is within the known photodegradative wavelength range.

13. The media of claim 1, wherein the media layer is paper or plastic.

14. The media of claim 1, wherein the thermally sensitive record layer is used with a tape.

15. The media of claim 1, wherein the thermally sensitive record layer is in the form of a coating, film, paint, decal, or applique.

16. A method of making a thermal sensitive media comprising the steps of:

providing a media layer, a lamination layer disposed internal to the media layer such that the lamination layer comprises a matrix of micro heating elements linked via fine circuit traces to a discharge generator, a thermally sensitive record layer, and an ultraviolet protective coating layer;

applying at least one light stabilizer capable of scavenging free radicals upon exposure to ultraviolet radiation;

forming the thermally sensitive record layer on the media layer;

disposing the ultraviolet protective coating layer over the thermally sensitive record layer; and positioning the lamination layer internal to the media layer.

17. The method of claim 16, wherein the matrix of micro heating elements is activated by RF power.

18. The method of claim 16, further comprising cutting the media to generate at least one antenna profile.

19. The method of claim 16, further comprising applying a protective film with the ultraviolet protective coating layer.

20. The method of claim 16, further comprising incorporating a layer of polyester film between the ultraviolet protective coating layer and the thermally sensitive record layer.

* * * * *